United States Patent [19]

Partridge

[11] Patent Number: 4,574,935

[45] Date of Patent: Mar. 11, 1986

[54] COIN CHECKING METHOD AND APPARATUS EMPLOYING WAVE TRAIN COMPARISON

[75] Inventor: David Partridge, West Wickham, England

[73] Assignee: 501 Starpoint Electrics Limited, Surrey, England

[21] Appl. No.: 591,580

[22] Filed: Mar. 20, 1984

[30] Foreign Application Priority Data

Mar. 21, 1983 [GB] United Kingdom ..... 8307697
Jan. 3, 1984 [GB] United Kingdom ..... 8400046

[51] Int. Cl.[4] ..... G07F 3/02
[52] U.S. Cl. ..... 194/319
[58] Field of Search ..... 194/100 A, 1 C, 1 D, 194/1 N, 99; 73/163

[56] References Cited

U.S. PATENT DOCUMENTS 3,901,368 8/1975 Klinger ..... 194/100 A

*Primary Examiner*—Stanley H. Tollberg
*Attorney, Agent, or Firm*—Larson and Taylor

[57] ABSTRACT

A coin 12 to be checked is passed through a test coil 1 connected in parallel with a capacitor 2. A comparison coil 3 having an adjustable core 5 is also connected in parallel with a capacitor 4 and a direct current is passed through both coils in parallel from a rail 13 to an interrupter 14. The simultaneous interruption of the current through both coils produces between each coil and its capacitor a respective oscillatory discharge in the form of a decaying wave train and the characteristics and dimensions of the two coils and their capacitors are such that when a coin of the selected denomination passes through the test coil, the two wave trains are substantially identical. The two wave trains are compared by a comparator device 6 and a voltage comparator 7 generates a signal when the result of the comparison is below a predetermined datum, thus indicating that the coin is a genuine one.

17 Claims, 4 Drawing Figures

VREF
7
6
4
5
3
R2
B
16
13
2
12
1
A
15
14

COIN CHECKING METHOD AND APPARATUS EMPLOYING WAVE TRAIN COMPARISON

This invention relates to the checking of coins and, in particular, to coin accepting mechanisms which operate in accordance with the result of such checking. Such mechanisms are used, for example, on vending machines and amusement machines and operate to accept genuine coins and reject the remainder. Rejected coins may be defective in one respect or another or may be forgeries and it is important to have an accurate system of checking in order to ensure that such forgeries are rejected and that even if the coin is genuine no other form of deception is being practised.

According to the present invention, a coin is checked by passing it through a coil connected in parallel with a capacitor, interrupting the flow of current through the coil when the coin is mid-way through the coil to cause between the capacitor and the coil an oscillatory discharge comprising a decaying wave train, comparing this train of waves with a reference wave train obtained by simultaneously interrupting the current through a comparison coil also having a capacitor in parallel with it, determining whether the result of the comparison is above or below a predetermined datum and generating a corresponding signal if it is below the datum.

Provided the coin is genuine, the resultant wave train will be effectively identical with the reference wave train and the result of the comparison will be to show a difference which is either zero or extremely small and under these circumstances the coin can be regarded as good and, subject to subsequent checks can then be accepted. If, however, an incorrect coin is used, i.e. a damaged coin, one of an incorrect denomination or a forgery, a comparison of the two wave trains will reveal differences greater than the predetermined datum value and the coin will be rejected. These differences may lie in the amplitude, frequency or attenuation of the wave train, but the overall effect will be the same, that is to say to produce a result of the comparison which is greater than the predetermined value, leading to rejection of the coin.

Although, in theory, a single interruption of the current through the coil is sufficient to provide the comparison just described, the current is preferably interrupted repeatedly, so that there is a continuous succession of wave trains for comparison purposes. If a genuine coin is held in position in the coil, then a continuous comparison will be obtained and the comparison coil itself can be adjusted so that the result of the comparison is to give a zero difference. Such adjustment is necessary at the time of initial setting-up, and is preferably achieved by the provision of an adjustable core for the comparison coil, the position of the core being adjusted in conjunction with a variable resistor in series with the coil to give zero difference when a genuine coin is in the test coil. The result of the comparison is found to depend on the effect of the eddy current reaction from the coin within the coil, this being equal to that of the comparison coil when a genuine coin is inserted, but differing from it in the case of an incorrect coin.

The adjustment just described is made with a genuine coin in a mid-way position in its travel through the test coil. At this position, the result of the comparison will be either zero or at most a small value less than the predetermined datum value. As the coin approaches this mid-way position, however, the difference will be greater than the predetermined datum value and it will also reach a value greater than the predetermined datum value as the coin leaves the coil. In other words, the result of the comparison will gradually decrease as the coin approaches the mid-way position and then increase again when it has passed this position. For an incorrect coin, the result of the comparison will be greater than the predetermined datum value at the mid-way point, but it is possible with some coins that a value less than the predetermined datum will be achieved both as the coin enters the coil and again as it leaves the coil. In order to prevent this result leading to the acceptance of an incorrect coin, the result of the comparison as the coin passes through the test coil is preferably continuously monitored and if this indicates that the difference falls below the predetermined datum on two occasions separated by a time interval greater than a predetermined length during the passage of the coin through the coil, no signal is generated. In other words, a coin is accepted only if a value below the predetermined datum is achieved at a single instant, or possibly two very closely spaced instants, in the passage of the coin through the coil.

The interruption of the current through the two coils is preferably controlled by a micro-computer which may also control other circuit functions. In particular, the micro-computer may control the generation of the necessary signal when the result of the comparison of the two wave trains is below the datum value and this control may be in addition to or in place of the control of the interruption of the current through the two coils. In addition, the micro-computer may also monitor the result of the comparison of the two wave trains.

A method of checking in accordance with the invention determines whether or not the coin is a good one. Before the coin can be accepted, precautions must be taken to guard against deceptions which can be practised even with a good coin. For example, the coin may be held on a string with the intention of subsequent withdrawal. If so, its subsequent movement will be restricted and it is therefore important to check on this also before generating an output signal indicating acceptance.

Accordingly, a coin accepting apparatus operating in response to a selected denomination of coin in accordance with the method of the invention comprises a test coil for the passage of a coin, connected in parallel with a capacitor, a comparison coil also connected in parallel with a capacitor, a circuit for passing a direct current through both coils in parallel and for simultaneously interrupting the current through both coils to produce between each coil and its capacitor a respective oscillatory discharge in the form of a decaying wave train, the characteristics and dimensions of the two coils and their capacitors being such that when a coin of the selected denomination passes through the test coil, the two wave trains are substantially identical, a comparator device for comparing the two wave trains and determining the result of the comparison, a device for generating a signal when the result of the comparison is below a predetermined datum, a coin accept mechanism responsive to a signal thus generated and means responsive to further movement of the coin prior to acceptance for generating an output signal.

Acceptance of a coin implies that it is allowed to pass to a cash box or other receptacle rather than being rejected and, at the same time, to cause a host machine to which the apparatus may be fitted to operate accordingly; in other words, to make an article available in a vending machine or to free an amusement machine for operation, to quote the two examples given above. In an amusement machine the coin will generally pass down to tube so as to be available for subsequent pay-out if required. It is the output signal which is generated as a result of the further movement of the coin before final acceptance that allows the operation of the host machine to take place.

The circuit for passing direct current to the two coils preferably includes a power interrupter for repeatedly interrupting the two currents and the comparator device then operates to make a continuous comparison. As mentioned above, a micro-computer can be included to control various features of the operation of such apparatus, particularly the interruption of the current through the two coils and the generation of the signal indicative of the result of the comparison of the two wave trains.

Preferably the micro-computer also monitors the result of the comparison continuously and if the result falls below the predetermined datum on two occasions separated by a time interval greater than a predetermined length during the passage of the coin through the coil, prevents the generation of the signal. In other words, if the passage of a faulty coin causes the result of the comparison to fall below the predetermined datum on two separate occasions, this prevents the coin being accepted and it is thus automatically rejected.

Generally speaking, the acceptance or rejection of a coin will be controlled by a deflector arranged in the acceptance path of a coin which, in its normal position, deflects a coin from the acceptance path into a rejection path. Receipt of a signal indicative of the comparison of the two wave trains being below the predetermined datum then removes the deflector so as to allow the coin in question to pass along the acceptance path. Most simply, the deflector may be removed by means of a solenoid which withdraws it into a wall forming one side of the acceptance path. The acceptance path may also include an optic device following the deflector and capable of producing a signal as the result of the passage of a coin, the micro-computer operating to return the deflector to its operative position by releasing the solenoid either on receipt of the signal from the optic device or after a predetermined time interval.

As mentioned above, it is the passage of a coin along the acceptance path which finally lead to the production of the output signal to the host machine, but as also mentioned, there may be circumstances when it is not appropriate to generate the output signal even though the coin has been checked and found good. As already described, one of the tricks used in an attempt to defraud an acceptance mechanism is to hold a genuine coin on a string and to withdraw it after it has activated the host machine. The use of such a string prevents the coin from reaching the optic device and the absence of a signal from the device will then prevent the micro-computer from generating the output signal. The absence of a signal from the optic device, within a predetermined period after the removal of the deflector, will also cause the latter to be returned to its operative position by release of the solenoid.

It is a characteristic of a coin acceptance mechanism in accordance with the invention that it will respond only to one selected denomination of coin. Accordingly, if a host machine may require the acceptance of more than one denomination, it is necessary to have a corresponding number of units of accepting apparatus, one for each denomination, and these may conveniently be arranged side by side with adjacent entrance apertures and may be controlled by a single, common micro-computer. The test and comparison coils for each channel will thus lie relatively close together and it is found in practice that there is the risk of interference between adjacent units, caused primarily by mutual inductance between the adjacent coils. Accordingly, under these circumstances, the detection by the test coil of any one of the units of the entry of a coin results in the micro-computer temporarily switching off all the other units until the coin in question no longer influences the test coil. This allows the acceptance or rejection of the coin producing the change to be completed, after which all the other units are switched on again. Accordingly, if, for example, two coins of different denominations were to be inserted practically simultaneously, the first coin would be processed in the normal way and the second would be rejected. By that time, however, all the units would have been switched on again and the second coin could then be re-inserted and processed normally.

An example of a single coin acceptance unit operating in accordance with the present invention will now be described with reference to the accompanying drawings, in which.

Figure 1:
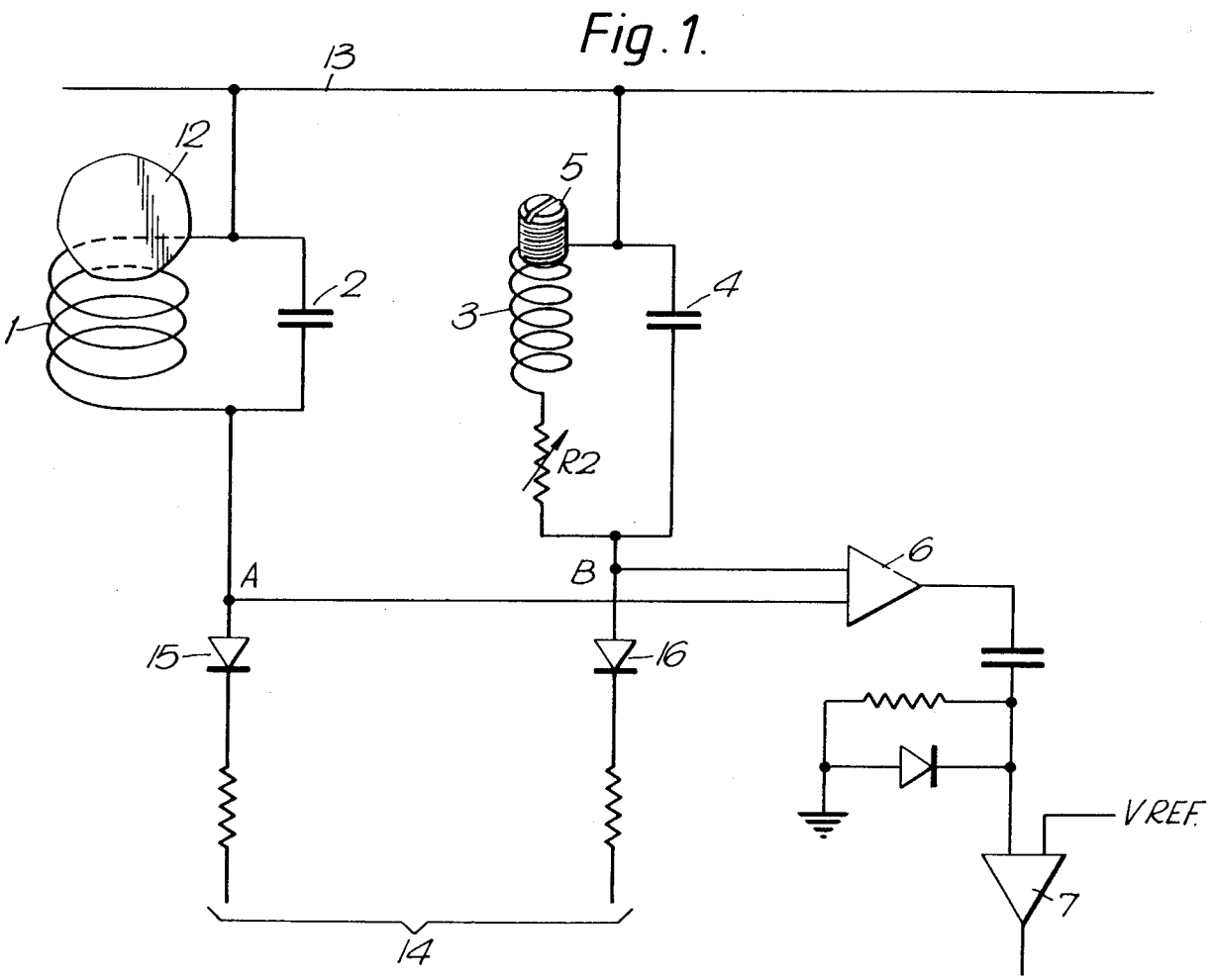
FIG. 1 is a schematic circuit diagram.

Referring first to FIG. 1, the system illustrated is intended to check only a single denomination of coin, e.g. a fifty pence piece 12. A coil 1 is wound on a former which defines an appropriately shaped slot to receive the coin to be tested. The coil 1 is connected in parallel with a capacitor 2 between a rail 13 and a power interrupter 14 which is connected to the other side of the supply. A comparison coil 3 having an adjustable core 5 is connected in parallel with a capacitor 4 and in series with an adjustable resistor R2, between the rail 13 and the interrupter. Diodes 15 and 16 isolate the two parallel circuits.

When the interrupter 14 simultaneously interrupts the current through the coils 1 and 3, both coils will go free and the respective capacitors 2 and 4 will charge and discharge through their coils to produce a decaying train of voltage oscillations which will appear at points A and B respectively.

The signals at the points A and B are fed to a comparator device such as a differential amplifier 6, the output of which represents the difference between the two signals. This output is then fed to a further device such as a voltage comparator 7 which determines whether or not the output of the differential amplifier 6, i.e. the difference of the two signals at A and B, is above or below a predetermined datum value fixed by the setting of the voltage comparator. The voltage comparator will give an output or not depending on the magnitude of the signal from the differential amplifier, and provided the output is below the predetermined datum value, the output of the comparator 7 will allow the coin to pass down an acceptance path by removing a deflector as described later. Unless the deflector is removed, the coin is automatically rejected.

At the time of initially setting up the equipment, a coin 12 is held at the mid-way position in the coil 1 and the core 5 and the resistor R2 are adjusted until the signals at the point A and B are substantially identical, thus leading to zero or very small output from the differential amplifier 6. As previously described, the presence of the cores in the coils 1 and 3 leads to an eddy current reaction when oscillatory current flows in the coil in question, thus giving rise to circuit losses and affecting the form of the decaying wave train which results when the current to the coil is interrupted. By equalising the eddy current effects in the two coils, the two wave trains can be made virtually identical. If subsequently, however, an incorrect coin e.g. of a different mass, different material or different size from a genuine coin 12 is passed through the coil 1, the wave trains are no longer identical, an appreciable output results from the amplifier 6 and since no accept signal is produced by the comparator 7, the coin is rejected.

The frequency of the interrupter 14 is such that a number of successive comparisons are made as a coin passes through the coil 1, normally under conditions of free fall. As just described, the equipment is intially set up with a coin in the mid-way position so that zero output from the amplifier 6 is obtained instantaneously as a genuine coin passes through this mid-way position. An incorrect coin, e.g. a forgery, will not give zero output at the mid-way position, but may possibly give zero output as it first enters the coil. If so, a corresponding zero reading will be given as the coin reaches the corresponding position when leaving the coil and by monitoring the time interval between these two zero output signals, they can be ignored and prevented from producing an accept signal Other forms of forgery and other incorrect coins may produce no zero output signal at all and therefore do not lead to any problem.

Since the oscillatory currents flowing in the coils 1 and 3 depend entirely on the characteristics of the coils themselves, their associated capacitors and the eddy current effect already described, the system does not suffer from oscillator drift which is a common problem in normal inductive sensing arrangements. Moreover, the system has also been found to be temperature stable, this being assisted by the fact that both coils 1 and 3 drift in the same direction.

The interrupter 14 is controlled by a micro-computer 24 described in detail with reference to FIG. 2. The micro-computer 24 also controls various other circuit functions including that just referred to, i.e. the monitoring of the time interval between two zero output signals and preventing the production of an accept signal if that interval exceeds a predetermined length. The micro-computer may also control several circuits of the form already described and designed to accept coins of different denominations, thus simulating what is generally known as a multiple coin acceptor. Each denomination of coin will, however, have its own individual entrance slot leading to the test coil 1 and insertion of a coin in an incorrect slot will automatically lead to rejection of that coin.

Figure 2:
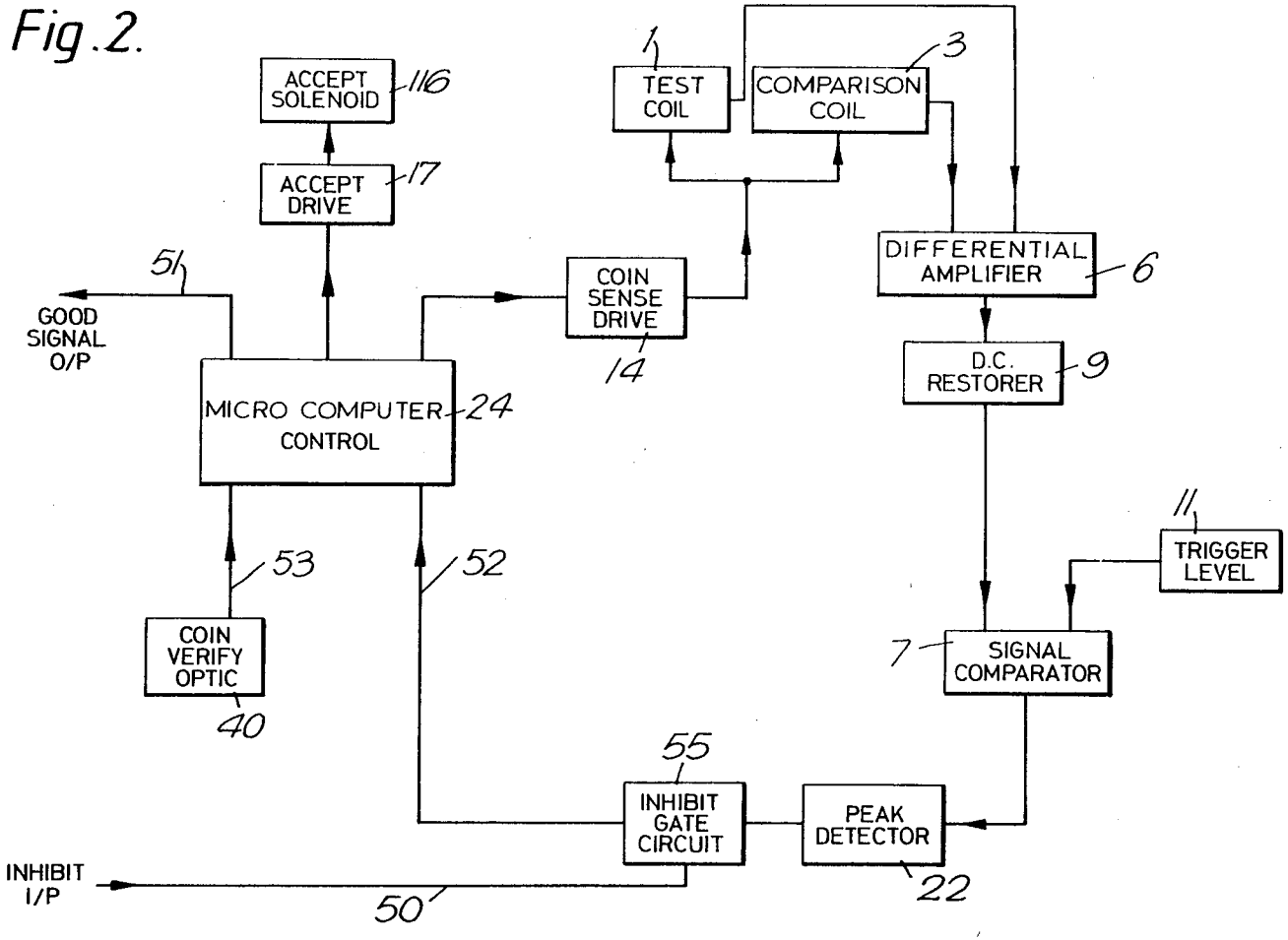
FIG. 2 is a block diagram illustrating the operation of a micro-computer controlling the apparatus as a whole.

Turning to FIG. 2, the components referred to in FIG. 1 are indicated by the same numerals, but are shown in block diagram. As shown in more detail in this Figure, the comparator 7 operates on the output from the amplifier 6 after it has been fed to a DC restoring device 9 where it is processed to give a result directly related to a datum value of zero volts. The voltage from the device 9 is fed to the comparator 7 where it is compared with the signal from a trigger level input 11. This sets the datum referred to above, i.e. the level at which the comparator 7 decides whether the test result is a pass or fail, that is to say whether or not the coin is a genuine one. As just described, for a genuine coin, the output signal is very low and the setting of the trigger level determines just how large the signal may become before a coin must be regarded as not being genuine.

For a low input signal, the comparator output will stay at zero volts and this low level is supplied to the micro-computer 24 via a peak detector circuit 22 in series with an inhibit gate circuit 55 and a line 52. If the input signal to the comparator 7 exceeds the set trigger level, the output of the comparator 7 provides a high level signal, via the peak detector 22 and the inhibit gate 55 to the input of the micro-computer 24. The interrupter 14 is controlled by the micro-computer 24 and may be referred to as a coil sense drive. Each time the micro-computer produces a pulse to the interrupter 14 to energise the coils 1 and 3, it also interrogates its sample input (after a small delay) to determine the outcome of the test. Provided the input signal from the peak detector 22 is low (i.e. corresponding to a genuine coin) and there is no channel inhibit, the micro-computer 24 energises a solenoid 116 by way of a drive circuit 17 and operation of the solenoid 116 moves a deflector to open an acceptance path for the coin. On the other hand, if a high input signal is detected (corresponding to a wrong coin or forgery) the program of the micro-computer makes the decision that no action is to be taken, which means that the solenoid 116 is not operated, the deflector is not moved and the coin is deflected down a reject path.

As described above, if the micro-computer controls more than one channel, e.g. four, in the particular example referred to, each of the separate channels operates in the manner just described. If, as will normally be the case however, the channels are arranged side by side with the coin apertures in line with one another, the signal and reference coils for each channel will lie close together and it is found in practice there is the risk of interference between adjacent channels, caused primarily by mutual inductance between the adjacent coils. Accordingly, when a number of channels are arranged side by side for control by the same micro-computer a further important feature of the invention is introduced. Expressed in general terms, the detection by any coil of any form of change, e.g. the entry of a good or bad coin, results in the micro-computer switching off all the other channels and concentrating on the channel in which the change has been detected until the coin producing the change no longer influences the coil. Under these circumstances, any coin passing through the channels which have been switched off causes no response and owing to the absence of any accept signal is automatically rejected.

For this purpose the coin test sequence in all the channels controlled by the micro-computer is split into two phases. In the first phase the micro-computer drives all the channels simultaneously and monitors these channels for the entry of a coin in the manner described above. As soon as the entry of a coin is detected, the second phase of the sequence begins, resulting in the channel in which the coin is detected carrying on with testing as described and the remaining channels being switched off for a short period while the tests are completed. The test functions for the two phases are carried out by the same circuit components. Phase one detects via the micro-computer when a coin approaches the test position, and phase two then continues with the remainder of the individual validation test. At the end of the test, the remaining channels are again switched on, so that the entry of a coin in any one of these channels is immediately detected.

Figure 3:
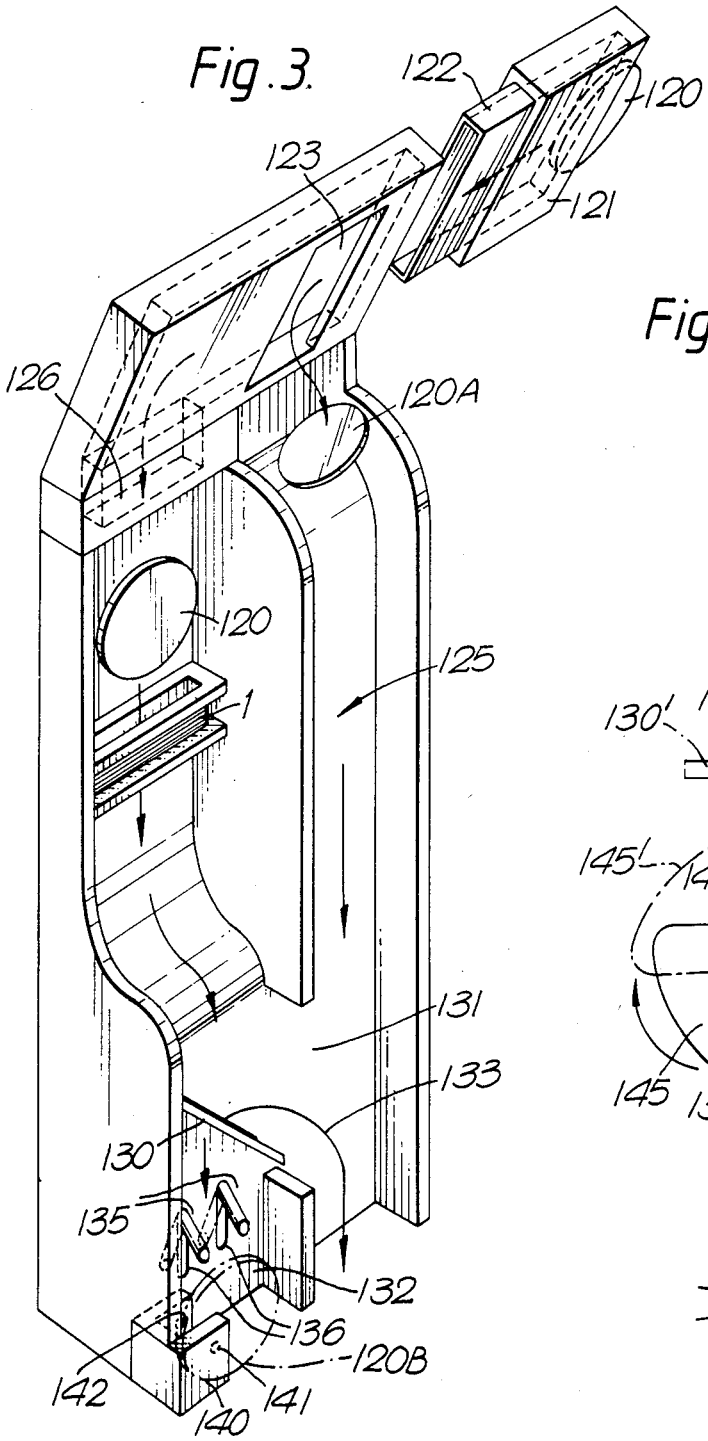
FIG. 3 is a perspective view illustrating the path of a coin through a test coil to a deflector which enables it to pass down either an acceptance or rejection path.

The physical features of the arrangement just described are illustrated in FIG. 3. A coin 120 is inserted through an aperture 121 which prevents the insertion of over-size coins. The coin then passes along a passage 122 of flat rectangular configuration which is inclined slightly to the vertical so that if the coin is undersize it will pass through an opening 123 in the lower side of the passage, as illustrated at 120A. The coin then falls down a vertical reject passage 125 and is returned to the operator. Provided the coin is of the correct size, however, it continues to the end of the inclined passage 122 and enters a generally vertical passage 126 leading to the test coil 1.

Figure 4:
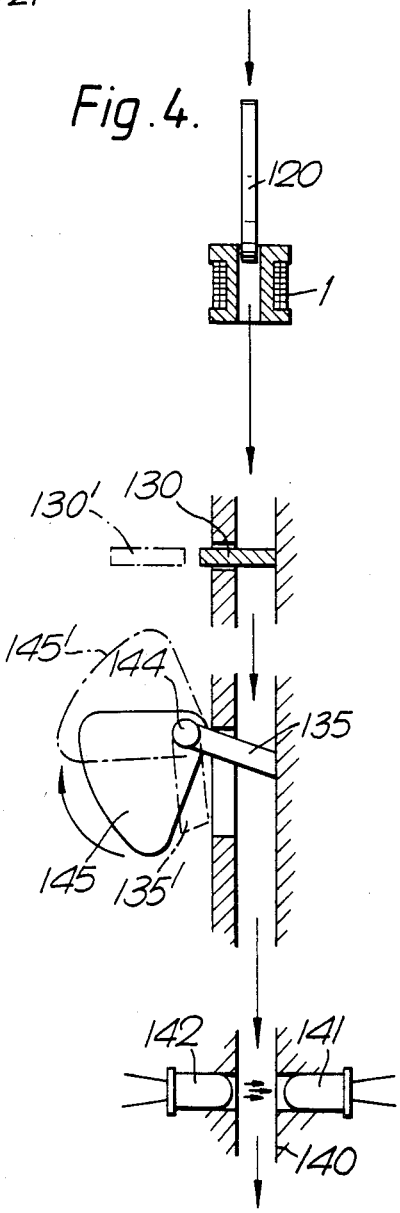
FIG. 4 is a diagrammatic sectional side view illustrating the operation of components located in the coin path as shown in FIG. 3.

The coin falls freely through the coil 1 and in so doing is subjected to the comparison already described. If the coin is a genuine one, the result of this comparison is that the solenoid 116 is operated and a deflector plate 130 is withdrawn from the position shown in FIG. 3 through the thickness of a wall 131 which defines the back of both the reject path 125 and an acceptance path 132. Retraction of the deflector 130 enables the coin 120 to continue down the acceptance path 132, but if the result of the comparison shows that the coin is not a genuine one, the solenoid 116 is not operated and the deflector 130 is not withdrawn. It therefore remains in the position shown in FIG. 3 and serves to deflect the coin in the direction of an arrow 133 into the reject path 125. If, however, the coin continues along the acceptance path 132, it next passes a non-return device comprising a pair of short pivoted arms 135 projecting through slots 136 in the back plate 131. The weight of the coin pivots the arms 135 downwardly, as illustrated in FIG. 4, but once past the arms 135, the coin cannot be withdrawn upwardly. The purpose of this is to avoid any possibility of a coin being inserted on a string, and then being withdrawn after it has served its purpose.

After passing the non-return device, the coin shown in dotted lines as 120B, passes an optic device 140 for verification purposes. The device 140 includes a photo transistor 141 and an infra-red diode 142, the beam which is normally incident upon the photo transistor 141, being interrupted by passage of the coin 120B. Signals from the device 140 are supplied to the micro-computer 24 along a line 53 as shown in FIG. 2 to provide further features in the overall control of the machine.

FIG. 4 shows the components in the path of the coin in side elevation. After passing through the test coil 1, the coin 120 reaches the deflector 130 which is illustrated in full lines in its extended position in which the coin is deflected into the reject path 125. Provided the result of the comparison has shown that the coin is a genuine one, the deflector 130 is withdrawn to the dotten line position 130' and the coin can continue downwardly past the non-return device constituted by the pivoted arms 135. As can be seen from FIG. 4, these arms turn about a pivot 144 and have a counter-weight 145. The weight of the coin over-rides the counter-weight 145 and pivots the arms 135 into the dotted line position 135', the counter-weight taking up the dotted line position 145'. As soon as the coin has passed, and before it reaches the optic device 140, the arms 135 return to the full line position and thus positively prevent return movement of the coin. The coin next passes through the optic device 140, the photo transistor 141 and the infra-red diode 142 being shown in rather more detail in this Figure. After passing through the optic device 140 and having satisfied all the various tests, the coin then passes either to a cash receptacle or to a tube as mentioned previously.

Although the solenoid 116 will normally be operated once a coin has passed its test and been proved genuine, there may be circumstances when the prevailing conditions are not suitable for accepting specific coins. An inhibit signal is externally applied to the inhibit gate circuit along a line 50 (FIG. 2) and even if a coin proves to be genuine, the output from the peak detector 22 will be prevented from activating the micro-computer control 24 therefore the solenoid 116 is not operated and the coin is deflected to the reject passage 125. If the coin is accepted, however, and following verification from the optic device 140, an appropriate output signal is passed along a line 51 to indicate that the coin is good and to render the host machine operational. Thus if the host machine is a vending machine, the product in question may be dispensed, or if it is an amusement machine, the machine is then ready for operation.

As mentioned above, signals derived from the photo transistor 141 in the optic device 140 are used for control purposes and the micro-computer is programmed to recognize any excessive delay between operation of the solenoid 116 and passage of the coin through the device 140. In particular, if the coin does not reach the device 140 at all, it indicates that the coin is being influenced externally, e.g. by being held on a string, and in these circumstances, the solenoid is deenergised after a set period and no output signal is fed along the line 51 so that the host machine will not become operational. If a coin is held on a string, it may remain in the device 140 so that the photo transistor 141 remains covered and this may also occur under other circumstances. The micro-computer then ensures that if further coins are inserted, the solenoid 116 will not be operated. In other words, the micro-computer effectively monitors the progress of a coin through the successive stages illustrated in FIG. 4.

I claim:

1. A method of checking a coin by passing it through a coil comprising the steps of: supplying direct current to a coil having a capacitor connected in parallel therewith; interrupting the supply of current to said coil when said coil is mid-way through said coil whereby to cause between said capacitor and said coil an oscillatory discharge comprising a first decaying wave train; supplying direct current to a comparison coil having a capacitor connected in parallel therewith; generating a reference wave train by simultaneously interrupting the supply of current to said comparison coil; comparing said first wave train with said reference wave train; determining whether the result of said comparison is above or below a predetermined datum and generating a corresponding signal if said result is below said datum.

2. A method according to claim 1 comprising repeatedly interrupting the supply of current to both said coils whereby to provide a continuous succession of first and reference wave trains which are continuously compared.

3. A method according to claim 2 in which the result of the comparison is continuously monitored and if the result falls below the predetermined datum on two occasions separated by a time interval greater than a predetermined length during the passage of the coin through the coil, no signal is generated.

4. A method according to claim 3, in which the result of the comparison is monitored by a micro-computer.

5. A method according to claim 1 in which the interruption of said current through said two coils is controlled by a micro-computer.

6. A method according to claim 1 in which the generation of the signal is controlled by a micro-computer.

7. A coin accepting apparatus operating in response to a selected denomination of coin, said apparatus comprising a test coil for the passage of a coin, a capacitor connected in parallel with said test coil, a comparison coil, a second capacitor connected in parallel with said comparison coil, a circuit for supplying a direct current to both said coils in parallel, means for simultaneously interrupting the supply of current to both said coils whereby to produce between each said coil and the respective capacitor respective oscillatory discharge in the form of a decaying wave train, the characteristics and dimensions of said two coils and said respective capacitors being such that when a coin of the selected denomination passes through said test coil, said two wave trains are substantially identical, a comparator device for comparing said two wave trains and determining the result of the comparison, a device for generating a signal when the result of the comparison is below a predetermined datum, a coin accept mechanism responsive to a signal thus generated, and means responsive to further movement of the coin prior to acceptance for generating an output signal.

8. Apparatus according to claim 7 in which the means for simultaneously interrupting the supply of direct current to the two coils includes a power interrupter for repeatedly interrupting the two currents, said comparator device operating to make a continuous comparison.

9. Apparatus according to claim 7 and further comprising an adjustable core within said comparison coil whereby with a coin of the selected denomination located centrally in said test coil, the two wave trains may be rendered substantially equal.

10. Apparatus according to claim 7 and including a micro-computer controlling the interruption of the current through said two coils.

11. Apparatus according to claim 7 and including a micro-computer controlling the generation of the signal indicative of the result of the comparison.

12. Apparatus according to claim 11 in which the micro-computer monitors the result of the comparison continuously and if the result falls below the predetermined datum on two occasions separated by a time interval greater than a predetermined length during the passage of the coin through the coil prevents the generation of the signal.

13. Apparatus according to claim 7 in which the coin accept mechanism includes an acceptance path for deflecting a coin into said rejection path and means for removing said deflector in response to receipt of a signal indicative of the comparison being below the predetermined datum whereby to allow a coin to pass along said acceptance path.

14. Apparatus according to claim 13 including a wall forming one side of said acceptance path and wherein said means for removing said deflector comprises a solenoid for withdrawing said deflector into said wall.

15. Apparatus according to claim 14 further comprising an optic device in said acceptance path following said deflector, said optic device producing a signal as the result of the passage of a coin and a micro-computer operating to return said deflector to its operative position by releasing said solenoid either on receipt of the signal from said optic device or after a predetermined time interval.

16. Apparatus according to claim 15 in which the absence of said signal from said optic device prevents said micro-computer from generating the output signal for a host machine.

17. A coin accepting system including a plurality of coin accepting apparatus units, each said unit comprising a test coil, a first capacitor connected in parallel with said test coil, a comparison coil, a second capacitor connected in parallel with said comparison coil, a circuit for supplying a direct current to both said coils in parallel, means for simultaneously interrupting the supply of current to both said coils whereby to produce between each said coil and the respective capacitor a respective oscillatory discharge in the form of a decaying wave train, the characteristics and dimensions of said two coils and said respective capacitors being such that when a coin of the selected denomination passes through said test coil, said two wave trains are substantially identical, a comparator device for comparing said two wave trains and determining the result of the comparison, a device for generating a signal when the result of the comparison is below a predetermined datum, a coin accept mechanism resposive to a signal thus generated, and means responsive to further movement of the coin prior to acceptance for generating an output signal, a common micro-computer controlling all said units, said micro-computer responding to the detection by said test coil of any one of said units of the entry of a coin to temporarily switch off all the other units until said detected coin no longer influences said test coil.

* * * * *